US005194033A

United States Patent [19]

Wright

[11] Patent Number: 5,194,033

[45] Date of Patent: Mar. 16, 1993

[54] PROJECTABLE TOY STUFFED ANIMAL

[76] Inventor: Joel R. Wright, 6850 S. Depew St., Littleton, Colo. 80123

[21] Appl. No.: 847,606

[22] Filed: Mar. 2, 1992

[51] Int. Cl.[5] ..... A63H 3/02

[52] U.S. Cl. ..... 446/311; 446/369

[58] Field of Search ..... 446/308, 309, 320, 311, 446/312, 486, 368, 369, 64, 268; 273/428

[56] References Cited

U.S. PATENT DOCUMENTS

| | | | |
|---|---|---|---|
| D. 179,949 | 3/1957 | Malsed | 446/320 X |
| 847,755 | 3/1907 | Flora | 446/311 |
| 1,408,001 | 2/1922 | Hauck | 446/64 |
| 4,505,687 | 3/1985 | Munro | 446/486 X |

OTHER PUBLICATIONS

WO91/13666, Hertel, Sep. 1991.

*Primary Examiner*—Mickey Yu

*Attorney, Agent, or Firm*—Charles C. Corbin

[57] ABSTRACT

Disclosed is a stuffed animal toy that is structured for being projected through the air, the toy body having a flexible outer layer with a fur-like exterior, head, neck region, trunk and an elongate tail projecting rearwardly from the trunk, the tail being provided with a plurality of annular folds therealong which allows it to be extendable to a substantially greater length, and an elongate elastic element is mounted entirely within the body of the toy, and extends, in its relaxed condition, from the tip of the tail where one end of the element is secured, to the underside of neck region where the other end of the element is secured. A thumb-grasp is also secured at the underside of the neck region. After grasping the ring with one hand and the tail end with the other hand, the elastic element may be stretched, which action extends the length of the tail. The toy can then be launched through the air by releasing the tail.

10 Claims, 1 Drawing Sheet

PROJECTABLE TOY STUFFED ANIMAL

BACKGROUND OF THE INVENTION

1.Field of the Invention

The present invention relates to toys specifically designed to be propelled through the air. More particularly, the invention relates to a toy stuffed animal that is adapted to be propelled through the air.

2. Description of the Prior Art

Various toys have been designed for being thrown through the air as a form of amusement, and these have been primarily in the area of air-foil equipped devices such as toy and model airplanes, and gliders. Such toys are usually fairly rigid structures of wings and fuselage, although the prior art includes non-flying devices such as the self-propelled dart of U.S. Pat. No. 3,162,444, and the throwing toy of U.S. Pat. No. 4,644,304. In some cases toys are in the form of a living creature and utilizes the power of a compressed spring to simulate the jumping or springing of the creature into the air. A stuffed animal that can be enjoyed both for its cuddly and aesthetic aspects as well as being propelled through the air has heretofore not been available.

SUMMARY OF THE INVENTION

In view of the foregoing, it is a general object of the present invention to provide a novel amusement device in the form of soft toys particularly designed to be projected through the air.

Another object of the invention is to provide a flexible bodied, non-rigid toy having self-propelling capabilities for projection through the air.

Yet another object is to provide a durable, effective and safe construction for a stuffed animal toy having self-propulsion mechanism that is concealed within the toy thereby preserving the aesthetic and cuddly aspects of the toy.

Accordingly, the present invention provides a stuffed animal toy that is particularly adapted for being propelled through the air, and having a soft body including an outer flexible skin that encases a mass of loose filler material, the body including a head, neck region and trunk, and featuring an elongated tail section extending rearwardly from the trunk. The featured tail section has a first, retracted length, and is characterized by a plurality of transverse annular folds in the skin of that region, and is extendable to an extended position of substantially increased length. There is an elongate elastic element totally embedded within the body and secured at one of its ends to the tip of the tail, and extending in its relaxed condition through the tail and trunk to the underside of the neck region where its forward end is secured to the skin. The exterior tip region of the tail is adapted to be grasped by hand, and secured to the neck region is a ring that is particularly adapted for engagement by the thumb of the hand. While grasping the ring with one hand and the tail end with the other hand, the elastic element can be stretched to move the tail to its extended position. The toy can then be launched through the air by releasing its tail.

A greater appreciation of the invention may be obtained by resort to the drawings, detailed description of a preferred embodiment and claims which follow.

DETAILED DESCRIPTION OF THE INVENTION

Figure 1:
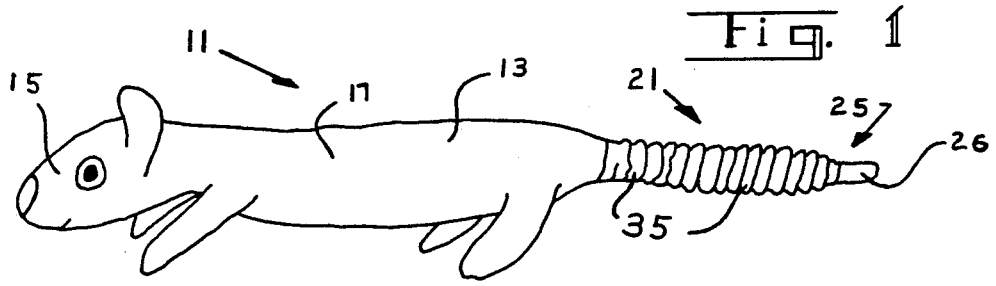
FIG. 1 is a side view in perspective of a preferred embodiment of a projectable stuffed animal according to the present invention.

Referring now to the drawings, FIG. 1 shows a preferred embodiment of a projectable stuffed toy animal 11 that has an outer skin 13 that encases a suitable loose fill material such as is commercially available under the trademark Polyfiber Fill. Skin 13 can be any suitable fake fur material and has a backing of a woven fabric material that is flexible, strong and fairly non-stretching. Toy 11 includes head 15, trunk portion 17, neck region 19 and tail portion 21.

There is an elongate elastic element 23 that is mounted within the body of the toy so as to extend in its relaxed condition from the tip of the tail 21 to the underside of the neck region 19. There are various suitable elastomer materials that can be used, and in the preferred embodiment a tubular surgical latex is employed. As FIGS. 2 and 3 indicate, a double length of rubber tubing is used to provide the durability, resilience and contracting force to propel stuffed toy 11 in a manner to be described. The tail region 21 has a generally tubular construction that encircles the elastic element 23 which has its rearward-most portion firmly secured to the fabric of tail tip portion 25 by stitching. The front end of elastic element 23 is firmly secured to the fabric of the neck region 19 by stitching.

Figure 2:
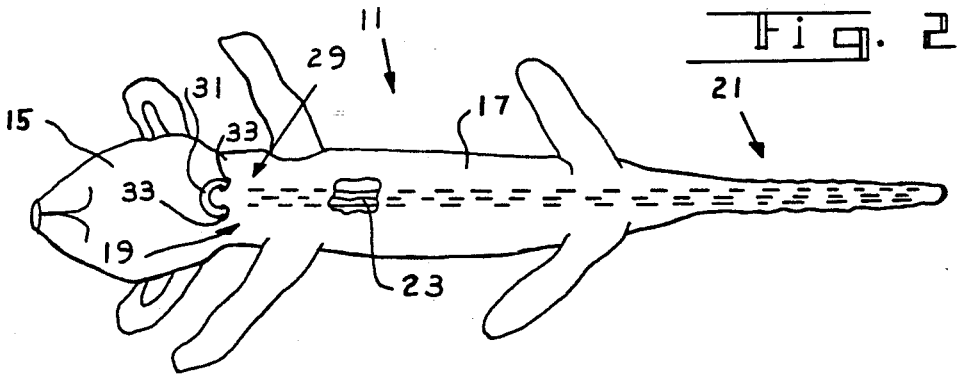
FIG. 2 is a bottom plan view of the toy shown in FIG. 1, with parts broken away.
Figure 3:
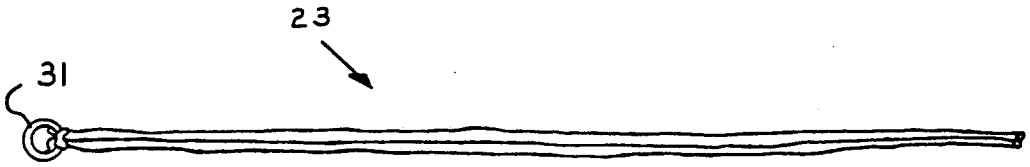
FIG. 3 is an enlarged top elevational view showing an elastic element used in conjunction with the preferred embodiment of the invention.

FIG. 3 best shows that there is a plastic ring 31 that is attached by knotting to the front of the elastic member 23. Ring 31 should be of sufficient size and strength to serve as a thumb grasp for use of toy 11 in a way to be described. FIG. 2 shows that one part of ring 31 is embedded under the fabric at a region of the neck indicated by reference numeral 29. The major part of ring 31 protrudes through a pair of openings 33. Ring 31 is preferably secured in such a manner that it will tend to lie flush against the surface of neck region 19.

While the major part of the toy body is fairly non-stretchable in the longitudinal direction, the tail region 21 is constructed to be extendable in the rearward direction so that its length can substantially increase over what is shown in FIGS. 1 and 2.

In the preferred embodiment a hand-graspable surface is provided at the end of tail region 21 by securing a leather-like cover 26 there.

Note that in addition to serving as a propulsion source, the elastic element 23 is preferably of a generally tubular construction having sufficient firmness to provide internal support for tail region 21 allowing it to be somewhat retained in a straight-back orientation. Tail region 21 is characterized by its skin being arranged in accordion-like fashion in an array of multiple annular folds 35.

When ring 31 is held in one hand, the tail portion 21 may be grasped with the other hand at surface 26 and then pulled backwardly to stretch and energize the elastic element 23. As this happens, the tail region 21 will extend and increase in length relative to the remainder of the body as the multiple folds 35 unfold.

Figure 4:
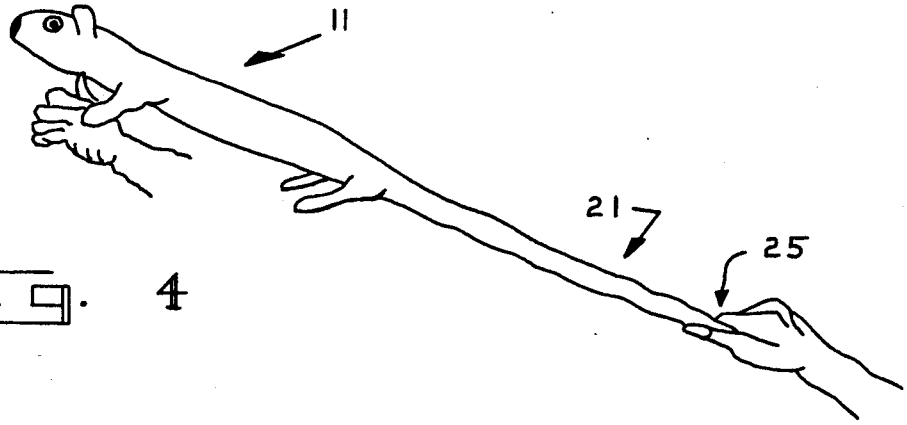
FIG. 4 is an illustration of the launch of a toy according to the invention.

FIG. 4 demonstrates how stuffed animal toy 11 may be launched into the air to provide a form of amusement heretofore unavailable in stuffed animal toys. When the tail is released, the force of the contracting elastic element 23 will act to propel toy 11 along an airborne trajectory.

While a preferred embodiment of the invention has been described, it shall be appreciated by those with ordinary skill in the art that, within the scope of the invention, various changes may be made. Thus, it is aimed to cover all such changes and modifications that fall within the true spirit and scope of the invention as defined by the claims which follow.

What is claimed is:

1. Toy animal adapted for being projected through air, including:

a) flexible body comprising an outer skin and loose filler material encased by said skin, said body including a head, neck region, trunk, and an elongate tail having a tip region and having a retracted position and a first length, and said tail adapted for being extended rearwardly to an extended position and to a second length substantially greater than said first length, and said tail having a tip region adapted for being grasped by hand;

b) elongate elastic element mounted within said body, and secured at one end to the tip region of said tail, said element having an unstretched condition and in its unstretched condition extending through said body from said tail to said neck region where the other end of said elastic element is affixed to said skin at said neck region;

c) thumb-grasp affixed to said neck region and adapted to be grasped by hand; and d) whereby movement of said thumb-grasp away from said tail tip will resiliently stretch said elastic element and said tail will move from its retracted position to said extended position.

2. Toy as defined in claim 1 wherein the skin of said tail is characterized by having a plurality of annular folds when said tail is in its retracted position.

3. Toy as defined in claim 2 wherein said tail folds are adapted to unfold as said tail is extended from its retracted position.

4. Toy as defined in claim 1 wherein said thumb-grasp comprises a ring, and one end of said ring is embedded within said neck region and secured to said elastic member.

5. Toy as defined in claim 4 wherein said ring projects through a pair of spaced-apart apertures in the skin of said neck region and the embedded part of said ring is held against outward movement by portions of said skin between said two apertures.

6. Toy as defined in claim 1 wherein said outer skin includes a flexible fabric backing that is relatively unstretchable.

7. Toy as defined in claim 1 wherein said elastic element comprises a tubular latex rubber material.

8. Toy as defined in claim 1 wherein said trunk portion is relatively inflexible in a longitudinal direction.

9. Toy as defined in claim 1 wherein said elongated tail is resiliently supported in a generally straight back orientation.

10. Toy as defined in claim 1 wherein said skin is a fake-fur material.

* * * * *